US008230557B2

(12) United States Patent
McNeil

(10) Patent No.: US 8,230,557 B2
(45) Date of Patent: Jul. 31, 2012

(54) NECKERCHIEF SLIDE

(76) Inventor: Randy L. McNeil, Estes Park, CO (US)

( * ) Notice: Subject to any disclaimer, the term of this patent is extended or adjusted under 35 U.S.C. 154(b) by 9 days.

(21) Appl. No.: 12/941,154

(22) Filed: Nov. 8, 2010

(65) Prior Publication Data

US 2012/0110790 A1 May 10, 2012

(51) Int. Cl.
*A41D 25/04* (2006.01)
*A41D 25/08* (2006.01)
*A41D 25/00* (2006.01)

(52) U.S. Cl. ..... 24/66.9; 2/144; 2/152.1; 2/905

(58) Field of Classification Search ..... 24/66.9, 24/316, 198, 495, 66.3, 52, 132 R, 53, 315, 24/49.1, 115 G, 136 R, 152.1; 2/328, 144, 2/153, 46, 138, 145, 148, 149, 152.1, 155, 2/905; 40/1.5
See application file for complete search history.

(56) References Cited

U.S. PATENT DOCUMENTS 552,818 A * 1/1896 Camillo ..... 2/150
568,128 A * 9/1896 Corser ..... 24/315
686,690 A 11/1901 Fishel
2,040,297 A * 5/1936 Costantini ..... 2/150
2,316,002 A * 4/1943 Koivisto ..... 2/144
2,617,108 A * 11/1952 Anzell ..... 2/153
2,631,292 A * 3/1953 Cunningham ..... 2/153
2,702,905 A * 3/1955 Peake ..... 2/153
2,714,719 A 8/1955 Peake
2,774,971 A * 12/1956 Schrade ..... 2/153
2,896,217 A 7/1959 Cedarstaff
2,915,757 A * 12/1959 Sofio, Sr. ..... 2/46
3,183,612 A * 5/1965 Romaine ..... 40/1.5
D203,154 S 12/1965 Harry
3,745,614 A * 7/1973 Tsang ..... 2/148
4,038,724 A 8/1977 Parizek
D280,572 S * 9/1985 Koppelmans ..... D11/204
4,573,219 A * 3/1986 Hooten ..... 24/66.3
5,008,981 A * 4/1991 Smithson ..... 24/66.9
5,010,593 A * 4/1991 Stevens, Jr. ..... 2/153
5,218,722 A * 6/1993 Vandenberg ..... 2/152.1
D358,019 S 5/1995 Lakin
D358,116 S 5/1995 Hughes
5,416,925 A * 5/1995 Davis ..... 2/144
5,493,731 A * 2/1996 Amnott ..... 2/148
5,774,893 A * 7/1998 Torres ..... 2/148
6,094,746 A * 8/2000 Miller ..... 2/152.1
6,763,785 B1 7/2004 Grady
6,920,642 B2 7/2005 Dickens
7,162,747 B2 * 1/2007 Sampy ..... 2/152.1

* cited by examiner

*Primary Examiner* — Robert J Sandy
*Assistant Examiner* — Louis Mercado
(74) *Attorney, Agent, or Firm* — Ancel W. Lewis, Jr.

(57) ABSTRACT

A neckerchief slide has one form that has a rigid body with a flat body portion and three spaced, rigid loops that project outwardly and rearwardly from the body portion, and a flashlight integrated into the body portion. The loops define apertures for the ends of a neckerchief. One end of the neckerchief goes through one aperture, the other end goes through another aperture, and both ends go behind the body portion and through the third aperture. The bulb of the flashlight points down during normal wear, and is easily pointed forward without removing the slide from the neckerchief or the flashlight from the slide. A second form of a neckerchief slide omits the flashlight. Indicia is displayed on the front of the neckerchief slide.

6 Claims, 2 Drawing Sheets

NECKERCHIEF SLIDE

This application claims the benefit under 35 U.S.C. §119 (e) of the U.S. provisional patent application No. 61/283,010 filed Nov. 25, 2009.

TECHNICAL FIELD

The present invention relates to neckerchief slide devices and more particularly to a three hole neckerchief slide with a rigid plate body portion.

BACKGROUND ART

Neckerchief slides are used to hold the two ends of a neckerchief to retain the neckerchief in place around the neck of a user. Neckerchief slides are an alternative to a knot in the two ends of the neckerchief. Prior known neckerchief slides are generally ring shaped. The two ends of the neckerchief are pushed in parallel through such ring shaped neckerchief slides. These neckerchief slides have been made from wood, metal, plastic and leather, and have been carved, cast, molded and woven.

At least two neckerchief slides with a triangular shape and three holes are offered by the Boy Scouts of America. One of these is made of flat leather and the other is cast metal.

DISCLOSURE OF THE INVENTION

A first form of neckerchief slide disclosed has a rigid body with a generally flat body portion and three peripherally spaced, Loop shaped projecting portions, and a flashlight. The body portion has a peripheral outer rim and the projecting portions are in the form of loops that project outwardly and rearwardly from the outer rim. The projecting portions each define a neckerchief aperture. The body portion has an inwardly facing inner rim defining a flashlight aperture and the flashlight fits into the flashlight aperture. The body has a gap from the inner rim to the outer rim and the flashlight has a light emitting element that emits light through the gap. A second form of neckerchief slide disclosed omits the flashlight, flashlight aperture and gap, and the body portion is continuous.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
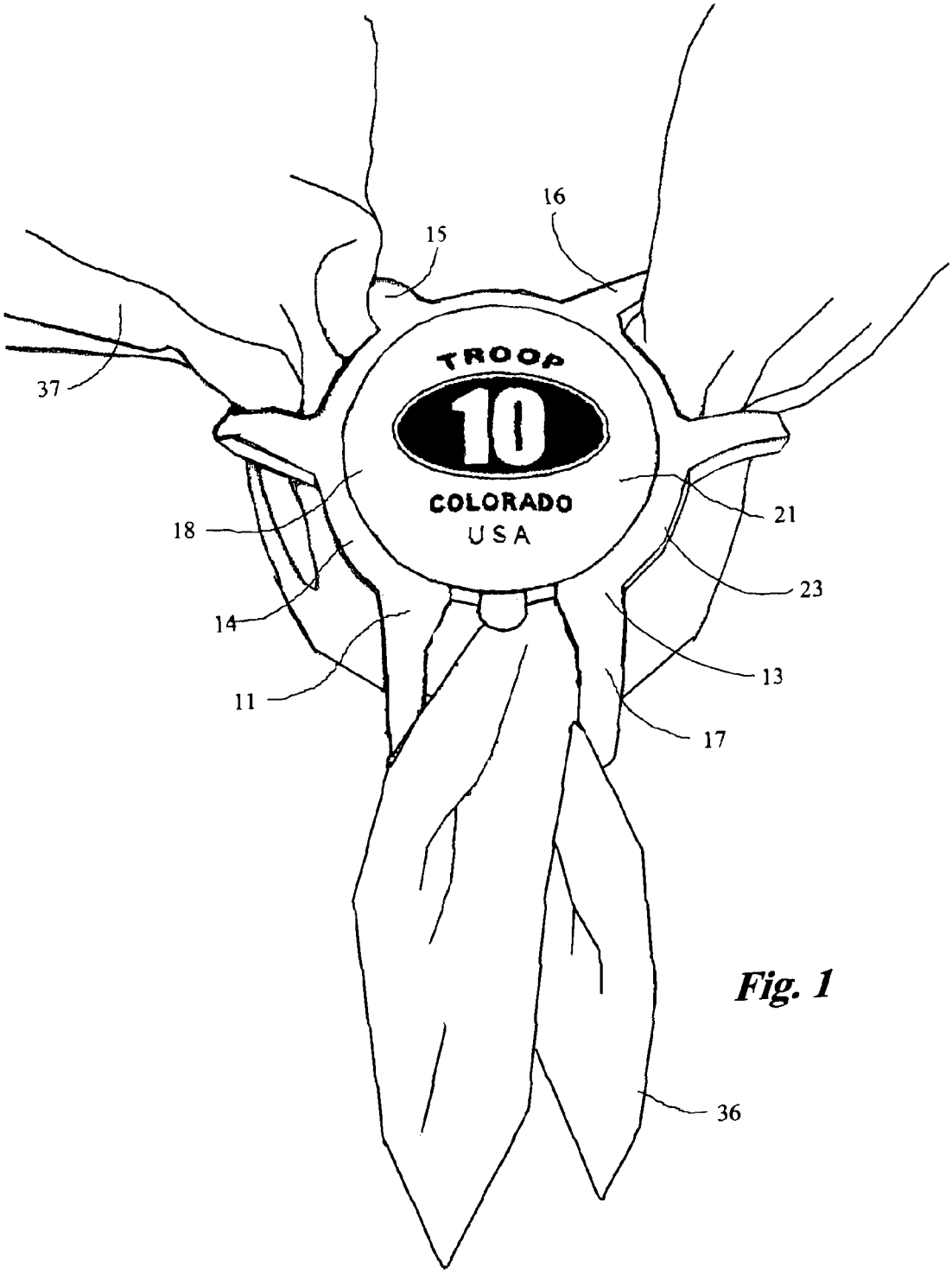
FIG. 1 is a front elevation view of a first form of a neckerchief slide embodying features of the present invention, with a neckerchief.
Figure 2:
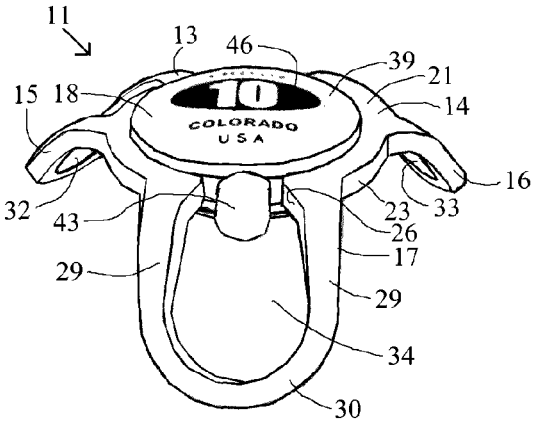
FIG. 2 is a perspective view of the slide of FIG. 1.
Figure 3:
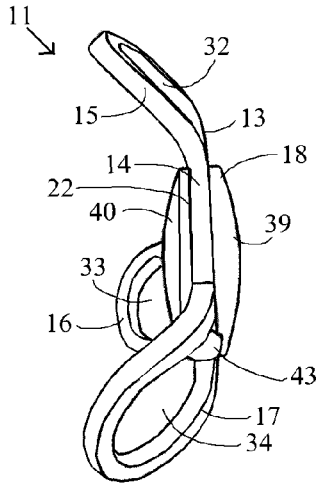
FIG. 3 is a lower, side elevation view of the slide of FIG. 1.
Figure 4:
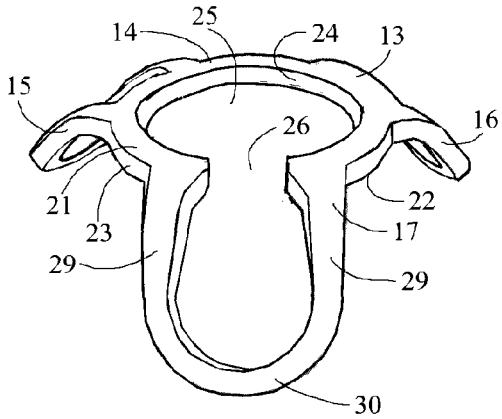
FIG. 4 is a front perspective view of the slide of FIG. 1, with the flashlight removed.
Figure 5:
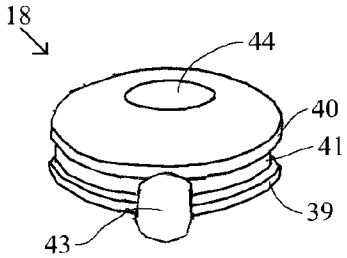
FIG. 5 is a back perspective view of the flashlight of the slide of FIG. 1.

Referring to FIGS. 1 to 5, a neckerchief slide 11, embodying features of the present invention, includes a body 13 and a flashlight 18. The body 13 has a body portion 14, a first projecting portion 15, a second projecting portion 16 and a third projecting portion 17. The body 13 is generally rigid and can be made of metal, plastic, wood or other rigid material. The body 13 shown is a single piece of uniform thickness, and is can be punched from a sheet or plate of metal or other punchable material. The body can alternatively be cast or injection molded in metal or plastic, or cut or carved from wood.

Describing the specific embodiments herein chosen for illustrating the invention, certain terminology is used which will be recognized as being employed for convenience and having no limiting significance. For example, the terms "front", "back", "up", and "down" will refer to the illustrated embodiment in its normal position of use. Further, all of the terminology above-defined includes derivatives of the word specifically mentioned and words of similar import.

The body portion 14 is generally flat having a front face 21, a spaced back face 22, and a peripheral outer rim 23 that extends between the front and back faces 21 and 22. The body portion 14 shown has a round outer rim 23. The outer rim 23 of the body portion 14 can be other shapes. By way of example, and not as a limitation, the outer rim 23 could be hexagonal or octagonal. The body portion 14 also includes an inwardly facing inner rim 24 that is spaced inwardly from the outer rim 23. The inner rim 24 shown is round. The inner rim 24 defines a flashlight aperture 25. A gap 26 extends from the inner rim 24 to the outer rim 23.

The first, second and third projecting portions 15, 16 and 17 are rigid, generally loop shaped to form loops, and project outwardly and rearwardly from the outer rim 23 of the body portion 14. If the body 13 is punched, the first, second and third projecting portions 15, 16 and 17 are bent rearwardly. Each of the first, second and third projecting portions 15, 16 and 17 have a pair of spaced leg portions 29 that project outwardly from the outer rim 23 and curve rearwardly, and an end portion 30 that connects the leg portions 29 opposite the outer rim 23. The leg portions 29 and the end portion 30, with the outer rim 23, of the first, second and third projecting portions 15, 16 and 17 define first, second and third neckerchief apertures 32, 33 and 34, respectively.

The first, second and third neckerchief apertures 32, 33 and 34 are sized to receive the ends 36 of a neckerchief, bandana or kerchief. The first and second projecting portions 15 and 16 project upwardly and laterally from opposite sides of the outer rim 23, and the third projecting portion 17 projects downwardly from the outer rim 23. The first, second and third projecting portions 15, 16 and 17 shown are equally spaced around the outer rim 23. Other spacings can be used. Preferably, the first and second projecting portions 15 and 16 are spaced symmetrically on opposite sides of the outer rim 23.

The flashlight 18 shown is round when viewed from the front and generally a flat oval shape when viewed from the side or top. The flashlight 18 has a convex front portion 39, a spaced, convex back portion 40, and an outwardly opening channel 41 between the front and back portions 39 and 40. The channel 41 is sized to fit into the flashlight aperture 25, with the front and back portions 39 and 40 extending outwardly beyond the inner rim 24 of the body portion 14. The flashlight 18 is integrated into the body portion 14 with the front and back portions 39 and 40 retaining the flashlight 18 in the body portion 14.

The flashlight 18 has a bulb or light emitting element 43, shown as a light emitting diode or LED, that projects outwardly from the channel 41. Other light emitting elements 43, such as an incandescent bulb, could be used. The light emitting element 43 projects into the gap 26 in the body portion 14, and emits light through the gap 26. The flashlight 18 includes a switch 44 on the back portion 40 to turn the light emitting element 43 on.

Indicia 46 is shown displayed on the front portion 39 of the flashlight 18. The indicia 46 shown is a message indicia for indicating the organization to which the user is a member. By way of example, and not as a limitation, a troop number and a geographic designation can be displayed.

In use the neckerchief slide 11 is put onto the neckerchief 37 by threading one end 36 of the neckerchief 37 into the first neckerchief aperture 32, threading the other end 36 of the neckerchief 37 into the second neckerchief aperture 33, and pulling both ends 36 of the neckerchief 37 behind the body portion 14 and through the third neckerchief aperture 34. In the first form shown, the light emitting element 43 points downwardly during normal wear, and is easily pointed forward or in any direction, and turned on, without removing the neckerchief slide 11 from the neckerchief 37.

Figure 6:
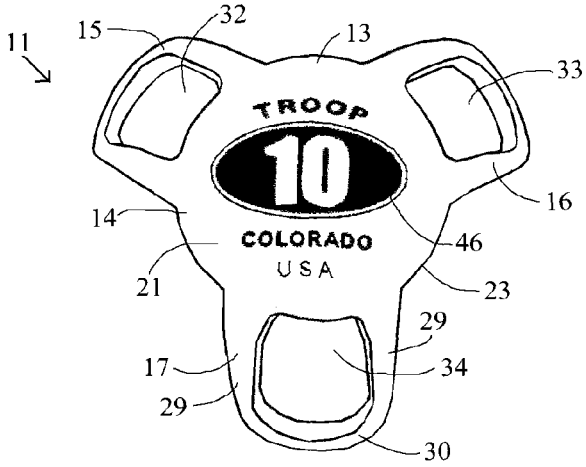
FIG. 6 is a front elevation view of a second form of a neckerchief slide embodying features of the present invention.

FIG. 6 shows a second form of a neckerchief slide 11 without a flashlight 18. The neckerchief slide 11 shown does not include an inner rim 24 or a gap 26, and the front face 21 is continuous from one side of the outer rim 23 to the other side of the outer rim 23. Indicia 46 can be displayed on the front face 21.

Although the present invention has been described with a certain degree of particularity, it is understood that the present disclosure has been made by way of example and that changes in details of structure may be made without departing from the spirit thereof.

What is claimed is:

1. A neckerchief slide for holding two ends of a neckerchief, comprising:

a generally flat, round body portion having a front face, a spaced back face, a peripheral outer rim between said front and back faces, an inner rim that defines a flashlight aperture that extends from said front face to said back face and a gap extending downwardly from said inner rim to said outer rim, spaced first, second and third projecting portions each having a pair of spaced leg portions that project outwardly and curve rearwardly from said rim and an end portion that connects said leg portions opposite said outer rim, said leg portions and said end portion of said first, second and third projecting portions, with said outer rim, defining first, second and third neckerchief apertures, respectively, said first and second projecting portions projecting upwardly and laterally from opposite sides of said outer rim, said third projecting portion projecting downwardly with said leg portions of said third projecting portion on opposite sides of said gap, said first, second and third projecting portions being equally spaced around said outer rim, said body portion and said first, second and third projecting portions being a single piece body, and a flashlight integrated into said body portion, said flashlight having a front portion, a spaced back portion and an outwardly opening channel between said front and back portions, said channel being sized and shaped to fit inside said inner rim with said front and back portions extending outwardly beyond said inner rim, said flashlight having a light emitting diode that is aligned with said gap and a switch on said back portion for activating said light emitting diode, whereby one end of said neckerchief goes through said first neckerchief aperture, the other end of said neckerchief goes through said second neckerchief aperture and both ends of said neckerchief go behind said body portion and through said third neckerchief aperture, and said flashlight emits light through said gap.

2. A neckerchief slide for holding two ends of a neckerchief, comprising:

a generally flat, rigid body portion having a front face, a spaced back face, and a peripheral outer rim between said front and back faces, and spaced, rigid, generally loop shaped first, second and third projecting portions that project outwardly and curve rearwardly from said outer rim that define first, second and third neckerchief apertures, respectively, whereby one end of said neckerchief goes through said first neckerchief aperture, the other end of said neckerchief goes through said second neckerchief aperture and both ends of said neckerchief go behind said body portion and through said third neckerchief aperture, said first, second and third projecting portions each having a pair of spaced leg portions and an end portion that connects said leg portions opposite said outer rim, said leg portions and said end portion of said first, second and third projecting portions, with said outer rim, defining first, second and third neckerchief apertures, a flashlight integrated into said body portion, said body portion having an inwardly facing inner rim that defines a flashlight aperture that extends from said front face to said back face, and said flashlight having a front portion, a spaced back portion and an outwardly opening channel between said front and back portions, said channel being sized and shaped to fit inside said inner rim with said front and back portions extending outwardly beyond said inner rim, whereby said body portion retains said flashlight.

3. The neckerchief slide as set forth in claim 2 wherein said body portion has a gap extending from said inner rim to said outer rim, and said flashlight has a light emitting element that is aligned with said gap, whereby said flashlight emits light through said gap.

4. The neckerchief slide as set forth in claim 3 wherein said third projecting portion projects downwardly and said gap is between said leg portions of said third projecting portion.

5. The neckerchief slide as set forth in claim 3 wherein said flashlight has a switch on said back portion for activating said light emitting element.

6. The neckerchief slide as set forth in claim 3 wherein said light emitting element is a light emitting diode.

* * * * *